US006699103B1

(12) United States Patent
Dieck et al.

(10) Patent No.: US 6,699,103 B1
(45) Date of Patent: Mar. 2, 2004

(54) MOWER REEL BLADE GRINDING DEVICE

(75) Inventors: James H. Dieck, River Falls, WI (US); Gregory A. Veenendall, River Falls, WI (US)

(73) Assignee: Foley-Belsaw Company, Minneapolis, MN (US)

( * ) Notice: Subject to any disclaimer, the term of this patent is extended or adjusted under 35 U.S.C. 154(b) by 0 days.

(21) Appl. No.: 10/365,585

(22) Filed: Feb. 12, 2003

(51) Int. Cl.[7] ..... B24B 3/00

(52) U.S. Cl. ..... 451/9; 451/421; 451/403; 451/141

(58) Field of Search ..... 451/141, 138, 451/421, 403, 9, 89

(56) References Cited

U.S. PATENT DOCUMENTS

| | | | | |
|---|---|---|---|---|
| 805,127 | A | | 11/1905 | Fetters |
| 2,180,911 | A | | 11/1939 | Rodgers |
| 2,279,798 | A | | 4/1942 | Shelburne |
| 2,314,945 | A | * | 3/1943 | Maynard et al. ..... 451/141 |
| 2,572,530 | A | * | 10/1951 | Smith ..... 451/129 |
| 2,780,034 | A | * | 2/1957 | Turner ..... 451/141 |
| 2,793,474 | A | * | 5/1957 | Smith ..... 451/9 |
| 3,724,139 | A | | 4/1973 | Leverenz |
| 4,005,554 | A | | 2/1977 | Campbell |
| D250,196 | S | | 11/1978 | Caccioli et al. |
| 4,148,158 | A | | 4/1979 | Hewitt |
| 4,192,103 | A | | 3/1980 | Sousek |
| 4,621,456 | A | | 11/1986 | Winstanley |
| 4,694,613 | A | | 9/1987 | Bernhard |
| 4,741,130 | A | | 5/1988 | Tano et al. |
| 4,993,199 | A | | 2/1991 | Hughes |
| 5,012,617 | A | | 5/1991 | Winstanley |
| D320,607 | S | | 10/1991 | Smith et al. |
| 5,291,724 | A | | 3/1994 | Cotton |
| 5,321,912 | A | | 6/1994 | Neary et al. |
| 5,333,112 | A | | 7/1994 | Bybee |
| 5,549,508 | A | | 8/1996 | Searle et al. |
| 5,558,560 | A | | 9/1996 | Uchida |
| 5,601,473 | A | | 2/1997 | Strain et al. |
| D386,504 | S | | 11/1997 | Dieck |
| 5,879,224 | A | | 3/1999 | Pilger |
| 6,010,394 | A | | 1/2000 | Dieck et al. |
| 6,290,581 | B1 | | 9/2001 | Dieck et al. |

OTHER PUBLICATIONS

"Neary Technology, Model 550SR Reel Grinder", brochure, undated.
"The Key to the Manicured Look" brochure, Foley United, undated.
"For a Safer Grind!" brochure, Foley United, undated.
"The Peerless 2000 Automatic Spin and Relief Grinder" brochure, Simplex Ideal Peerless, undated.
"The Peerless 1360 Automatic Spin and Relief Grinder" brochure, Simplex Ideal Peerless, undated.
"Landpride Turf Reel Grinders" brochure, Landpride Turf, undated.
"Express Dual" brochure, Bernhard & Company Ltd., undated.
"Neary Spin–Matic II" brochure, Neary Manufacturing, copyright 1986.
"Ransomes Precision Grinders" brochure, Ransomes America Corporation, copyright 1994.

* cited by examiner

*Primary Examiner*—George Nguyen
(74) *Attorney, Agent, or Firm*—Dorsey & Whitney LLP

(57) ABSTRACT

The present invention is a device for relief grinding a blade having a radially outer edge of an elongated length and first and second faces, with the first and second faces extending generally radially from a reel axis. The device includes a rotatable grinding shaft, a grinding wheel, a grinding wheel guide assembly, a guide finger, and a first non-sliding stabilizer.

16 Claims, 12 Drawing Sheets

MOWER REEL BLADE GRINDING DEVICE

BACKGROUND OF THE INVENTION

The present invention, relates to grinding systems, and more specifically to methods and apparatus for automatically sharpening blades on cutting reels of lawn mowers.

Commercial reel-type lawn mowers typically utilize cutting reels that have helical blades. The cutting reels must be maintained regularly to assure proper operation. Part of such maintenance involves sharpening the blades and sharpening and/or adjusting the bed knives. The sharpening process typically involves two steps. The first step involves spin grinding the tips or radially outer ends of the blades in order to true the reel back to cylindrical shape and sharpen the cutting edge. The second step involves relief grinding the trailing edge of each blade.

U.S. Pat. No. 5,321,912 to Neary et al. teaches a grinding system for spin and relief grinding cutting reels of commercial reel-type lawn mowers. The Neary et al. grinding system utilizes a common rotating drive shaft to rotate a spin grinding wheel and a relief grinding wheel. Both grinding wheels are separately axially slideably mounted on the common rotating shaft, which is generally parallel to the axis of the cutting reel to be ground. While the Neary et al. system offers the common rotating shaft, which is a desirable feature to many grinder operators, it lacks a means of auto indexing from blade to blade. Thus, the Neary et al. grinding system requires an operator to manually cycle each blade through the relief grinding process. This is labor intensive and time consuming. In addition, the fork assemblies 32 on either side of the grinding wheels necessarily wear from sliding contact with the grinding wheels and/or grinding shaft 18, and they provide poor positioning stability for the grinding wheels.

U.S. Pat. No. 6,010,394 to Dieck et al. teaches a grinding system for spin and relief grinding cutting reels of commercial lawn mowers. The Dieck et al. grinding system utilizes a movable grinding head, which includes a grinding wheel and a motor mounted on a carriage. The grinding head is slideably mounted on rails that are generally parallel to the axis of the cutting reel. The Dieck et al. system offers an auto indexing system for automatically indexing from blade to blade.

There is a need in the art for a grinding system that allows auto indexing on a grinding system utilizing a common rotational shaft, reduces part friction and wear, and improves grinding accuracy.

BRIEF SUMMARY OF THE INVENTION

The present invention, in one embodiment, is a device for relief grinding a blade having a radially outer edge of an elongated length and first and second faces, with the first and second faces extending generally radially from a reel axis. The device includes a rotatable grinding shaft, a grinding wheel, a grinding wheel guide assembly, a guide finger, and a first non-sliding stabilizer.

The rotatable grinding shaft defines a grinding wheel axis. The grinding wheel is rotatable with and axially slideable along the grinding shaft to follow the elongated length of the blade. The grinding wheel includes a hub with a first bearing surface. The grinding wheel guide assembly is mounted for motion parallel to the grinding wheel axis on at least one rail that extends the elongated length of the blade and is substantially parallel to the grinding wheel axis. The guide finger is adjustably supported on the grinding wheel guide assembly for contacting one face of the blade during grinding and holding the blade in position for relief grinding. The first non-sliding stabilizer bearing is supported on the grinding wheel guide assembly for bearing contact with the first bearing surface. The first stabilizer bearing is oriented to apply to the first bearing surface forces applied to the grinding wheel guide assembly that include a component parallel to the grinding wheel axis.

The present invention, in another embodiment, is a device for relief grinding a blade having a radially outer edge of an elongated length and first and second faces, with the first and second faces extending generally radially from a reel axis. The device includes a rotatable grinding shaft, a grinding wheel, a grinding wheel guide assembly, a guide finger, and a first non-sliding stabilizer bearing.

The rotatable grinding shaft defines a grinding wheel axis. The grinding wheel is rotatable with and axially slideable along the grinding shaft to follow the elongated length of the blade. The grinding wheel includes a hub with a stabilizer bearing surface. The grinding wheel guide assembly is mounted for motion parallel to the grinding wheel axis on at least one rail that extends the elongated length of the blade and is substantially parallel to the grinding wheel axis. The guide finger is adjustably supported on the grinding wheel guide assembly for contacting one face of the blade during grinding and holding the blade in position for relief grinding. The first non-sliding stabilizer bearing is interposed for bearing contact between the grinding wheel guide assembly and the stabilizer bearing surface. The first stabilizer bearing is oriented to apply to the stabilizer bearing surface forces applied to the grinding wheel guide assembly including both a component parallel to the grinding wheel axis and a component perpendicular to the grinding wheel axis.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
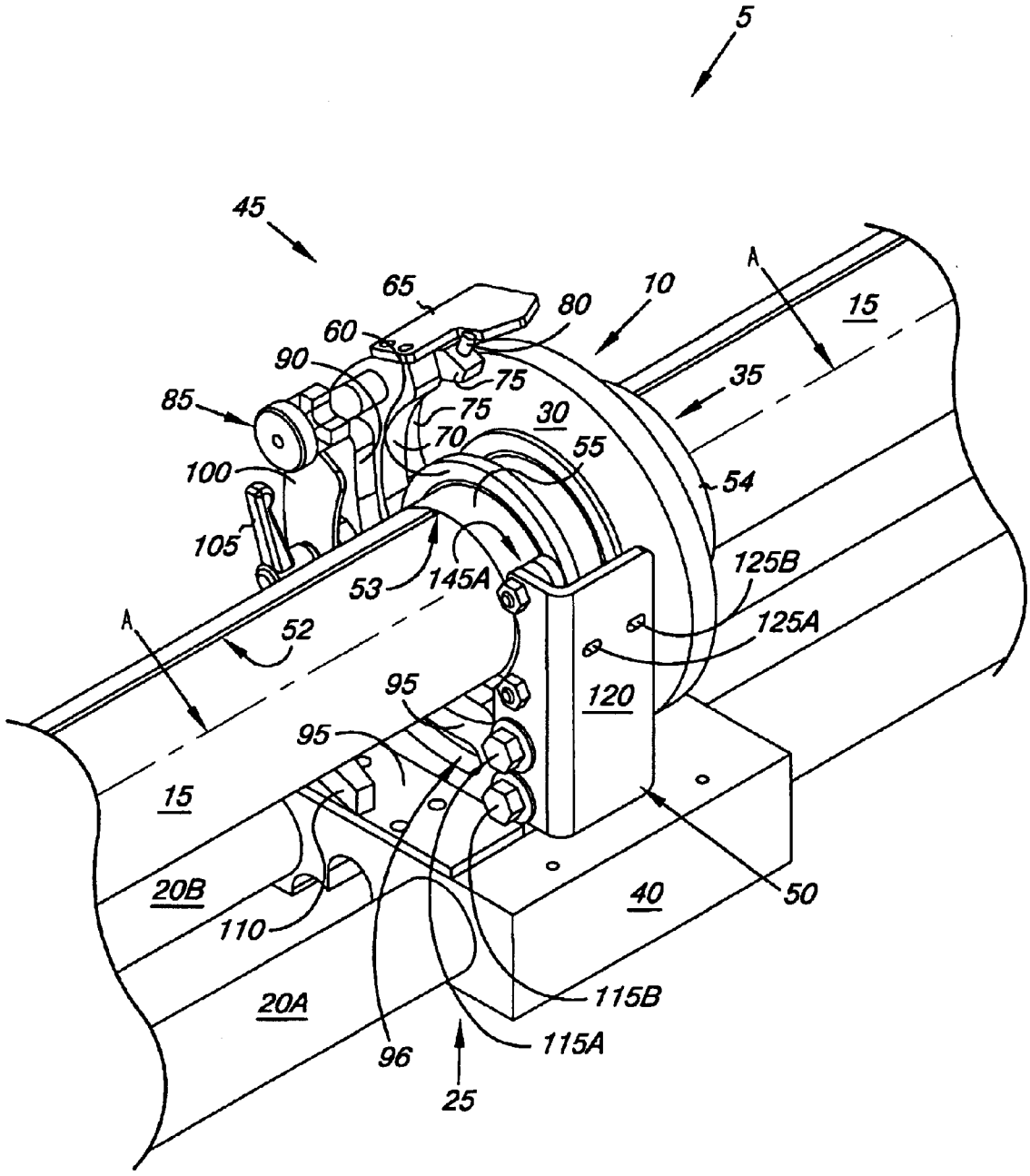
FIG. 1 is an isometric view of a relief grinding device having a rotating shaft for rotating a grinding wheel assembly of the device.

FIG. 1 shows an isometric view of a relief grinding device 5 for relief grinding helical blades on cutting reels of lawn mowers. An advantageous aspect of the grinding device 5 is that it allows a grinding system utilizing a common rotational shaft and mechanism to auto index the blades of the cutting reel undergoing a relief grinding procedure.

As shown in FIG. 1, the device 5 includes a grinding wheel assembly 10, a rotating grinding shaft 15, two rails 20*a*, 20*b*, and a grinding wheel guide assembly 25 mounted on the rails 20*a*, 20*b*. The grinding wheel assembly 10 comprises a grinding wheel 30 mounted on a hub 35. The guide assembly 25 includes a traveling block 40, an indexing assembly 45, and a stabilizer assembly 50. The shaft 15 has a keyway 52 that runs the length of the shaft 15 and generally parallel to the shaft's rotational axis, which is axis A in FIG. 1.

As will be explained in greater detail later in this specification, during a relief grinding operation, the shaft 15 causes the grinding wheel assembly 10 to rotate about axis A, which causes the grinding wheel 30 to spin against a cutting reel blade that is mounted above the grinding wheel 30 generally parallel to axis A. The guide assembly 25 travels along the rails 20*a*, 20*b*, moving the grinding wheel assembly 10 axially along the shaft 15, which causes the spinning grinding wheel 30 to travel the length of the blade.

The stabilizer assembly 50 resists forces exerted on the indexing assembly 45 by the blade, which is biased against the indexing assembly 45. Thus, the positioning of the indexing assembly 45 relative to the blade, grinding wheel 30, and axis A is maintained within tight tolerances.

Once the entire length of the blade has been relief ground, the indexing assembly 45 allows the next cutting reel blade to rotate into position for grinding. In one embodiment of the invention, the grinding wheel 30 must travel down the length of the blade and back before the indexing assembly 45 will allow the next blade to rotate forward. In another embodiment, the grinding wheel 30 must only travel down the length of the blade before the indexing assembly 45 will allow the next blade to rotate forward.

Figure 2:
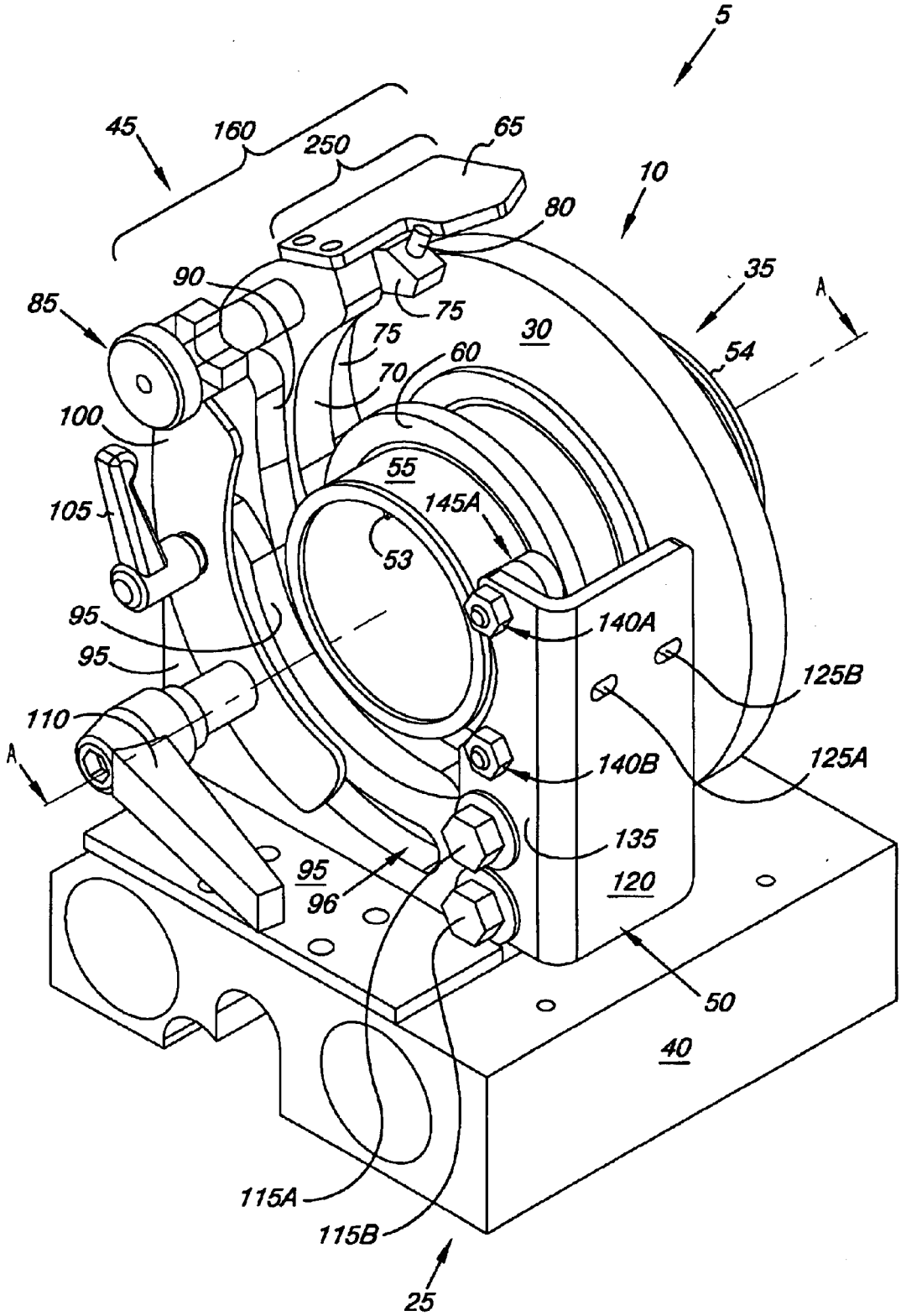
FIG. 2 is the same isometric view of FIG. 1, except the rotating shaft has been removed for clarity.

FIG. 2 is the same isometric view of FIG. 1, except the shaft 15 has been removed to allow a clearer depiction of the device 5. Aspects of the hub 35 that can be seen in FIG. 2 include a key 53, a threaded collar 54 that allows for replacement of the grinding wheel 30, a cylindrical outer surface 55 and an annular stabilizer flange 60, which radiates out from the hub's cylindrical outer surface 55 generally perpendicular to the rotating shaft's rotational axis A. The key 53 engages the keyway 52 in the shaft 15. The key 53 may slide along the keyway 52 but cannot rotatably displace relative to the shaft 15. Thus, the hub 35 is axially slideably mounted on, and rotatably fixed to, the rotating shaft 15. As will be described below, the cylindrical outer surface 55 of the hub 35 and the annular stabilizer flange 60 serve as a bearing surfaces.

The indexing assembly 45 and the stabilizer assembly 50 are mounted on the traveling block 40, which is slideably mounted on the two rails 20*a*, 20*b*. Aspects of the indexing assembly 45 that can be seen in FIG. 2 include a guide finger 65, a guide finger support 70, an index finger 75, an index finger tip 80, an index finger travel adjustor 85, a cam follower carrier 90, a slotted base 95 that has a curved slot 96, a slot cover 100, a linear adjustment lock lever 105, and a radial adjustment lock lever 110. The slot cover 100 helps to prevent dust and grindings from entering the curved slot 96. In another embodiment of the invention, where protection from dust or grindings is not required, the slot cover 100 may be replaced with a washer that is centered about the shaft of the radial adjustment lock lever 110 and spans across the curved slot 96.

The stabilizer assembly 50 is bolted to the slotted base 95 by two bolts 115*a*, 115*b*. The stabilizer assembly 50, in one embodiment, serves three purposes. First, as the traveling block 40 is displaced to traverse the length of a blade, elements of the stabilizer assembly 50 act on the annular stabilizer flange 60 of the hub 35, thereby causing the grinding wheel assembly 10 to displace axially along the rotating shaft 15 (axial thrust action). Second, the stabilizer assembly 50 maintains the indexing assembly 45 in position relative to the grinding wheel 30 by resisting a bending moment along axis A. In other words, the stabilizer assembly 50 prevents the bending moment from displacing the guide finger 65 axially relative to axis A. That is to say the stabilizer assembly 50 prevents the guide finger 65 from deflecting side to side. Finally, the stabilizer assembly 50 maintains the indexing assembly 45 in position relative to the grinding wheel 30 by resisting a torsional moment about axis A. In other words, the stabilizer assembly 50 prevents the torsional moment from displacing the guide finger 65 radially relative to axis A. That is to say the stabilizer assembly 50 prevents the guide finger 65 from deflecting front to back.

Both the bending and torsional moments result from forces exerted on the indexing assembly 45 by a blade biasing against the guide finger 65 of the indexing assembly 45 and/or by the grinding wheel 30 forcing the blade against the guide finger 65 of the indexing assembly 45. In some embodiments of the subject invention (see FIGS. 1–7 and 10–11), these forces are transferred from the indexing assembly 45 to the rotating shaft 15 via the stabilizing assembly 50. Since the rotating shaft 15 does not measurably deflect under the magnitude of forces exerted by the biased blade on the indexing assembly 45, the stabilizer assembly 50 has a rigid foundation on which to prevent deflection of the guide finger 65 relative to axis A. In other embodiments of the subject invention (see FIGS. 8*a*, 8*b*, 9*a*, 9*b*), the force is transferred (in whole or in part) to stiffened profiled rails, which provide the rigid foundation necessary for the guide assembly 25 to prevent deflection of the guide finger 65 relative to axis A.

The axis of the rotating shaft (i.e., axis A) does not measurably displace relative to the axis of the cutting reel during the relief grinding process. Therefore, failure to maintain the position of the guide finger 65 relative to axis A during the relief grinding process can result in unacceptable variance in the angle of relief over the length of the blade being relief ground. The embodiments of the subject invention maintain the guide finger 65 sufficiently rigid with respect to axis A so that the forces during grinding do not significantly displace the guide finger 65 axially or radially relative to axis A.

As will be explained further in this specification, the stabilizer assembly 50, in one embodiment, is a device that transfers the grinding wheel assembly 10 along the rotating shaft 15, resists a bending moment along axis A, and resists a torsional moment about axis A, all while generating minimal part wear and friction between elements of the grinding wheel assembly 10 and the stabilizer assembly 50. In other words, the stabilizer assembly 50, in one embodiment, maintains the indexing assembly 45 (i.e., the guide finger 65) in position relative to axis A and the grinding wheel 30 while generating minimal part wear and friction between the elements of the grinding wheel assembly 10 and the stabilizer assembly 50.

Aspects of the stabilizer assembly 50 that can be seen in FIG. 2 include: a first vertical plate 120, which forms a plane that is generally parallel to axis A and has two holes 125*a*, 125*b* for mounting flange rollers 130*a*, 130*b* (shown in subsequent FIGS.); and a second vertical plate 135, which forms a plane that is generally perpendicular to axis A and has bolts 115*a*, 115*b*, 140*a*, 140*b*. Bolt 140*a* secures an upper hub roller 145*a* to the second vertical plate 135. Likewise, bolt 140*b* secures a lower hub roller 145*b* (shown in subsequent FIGS.) to the second vertical plate 135. In the embodiment of the invention illustrated, the first and second vertical plates 120, 135 form one continuous piece. In another embodiment, the first and second vertical plates 120, 135 are two separate pieces that are secured together.

Figure 3:
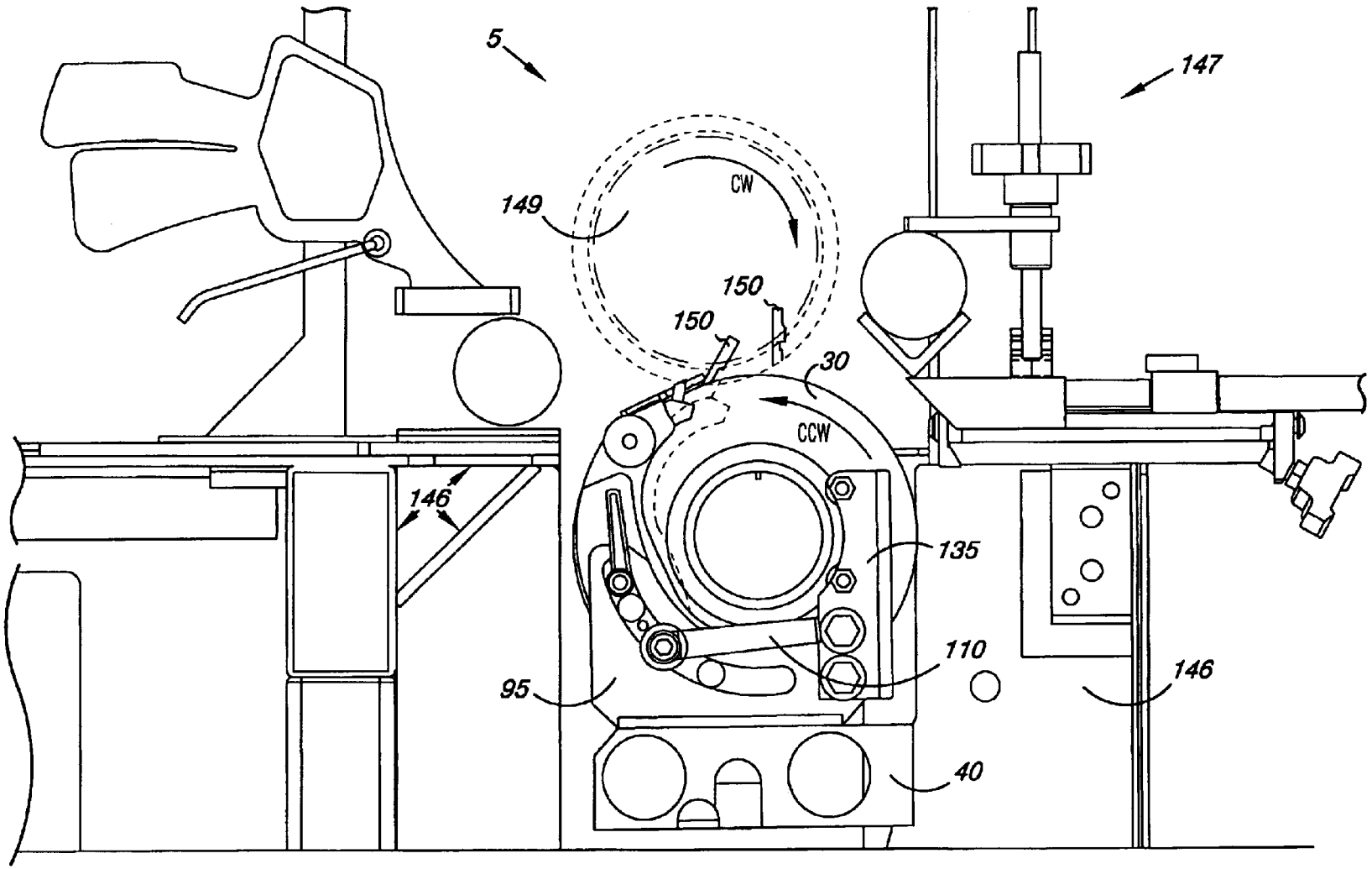
FIG. 3 is a left side elevation view of the device located within the surrounding framework of the overall grinding system with a cutting reel shown in phantom and wherein the line of sight runs parallel with the axis of the rotating shaft.

To provide an understanding of how the device 5 spatially relates to the overall grinding system and the cutting reel, reference is now made to FIG. 3. FIG. 3 is a left side elevation view of the device 5 located within the surrounding framework 146 of the overall grinding system 147. The device 5 is located below a cutting reel 149, which has a plurality of helical blades 150 with opposed first and second faces and is supported for rotation about the reel axis to sequentially position the blades 150 for grinding by the grinding wheel 30.

Figure 4:
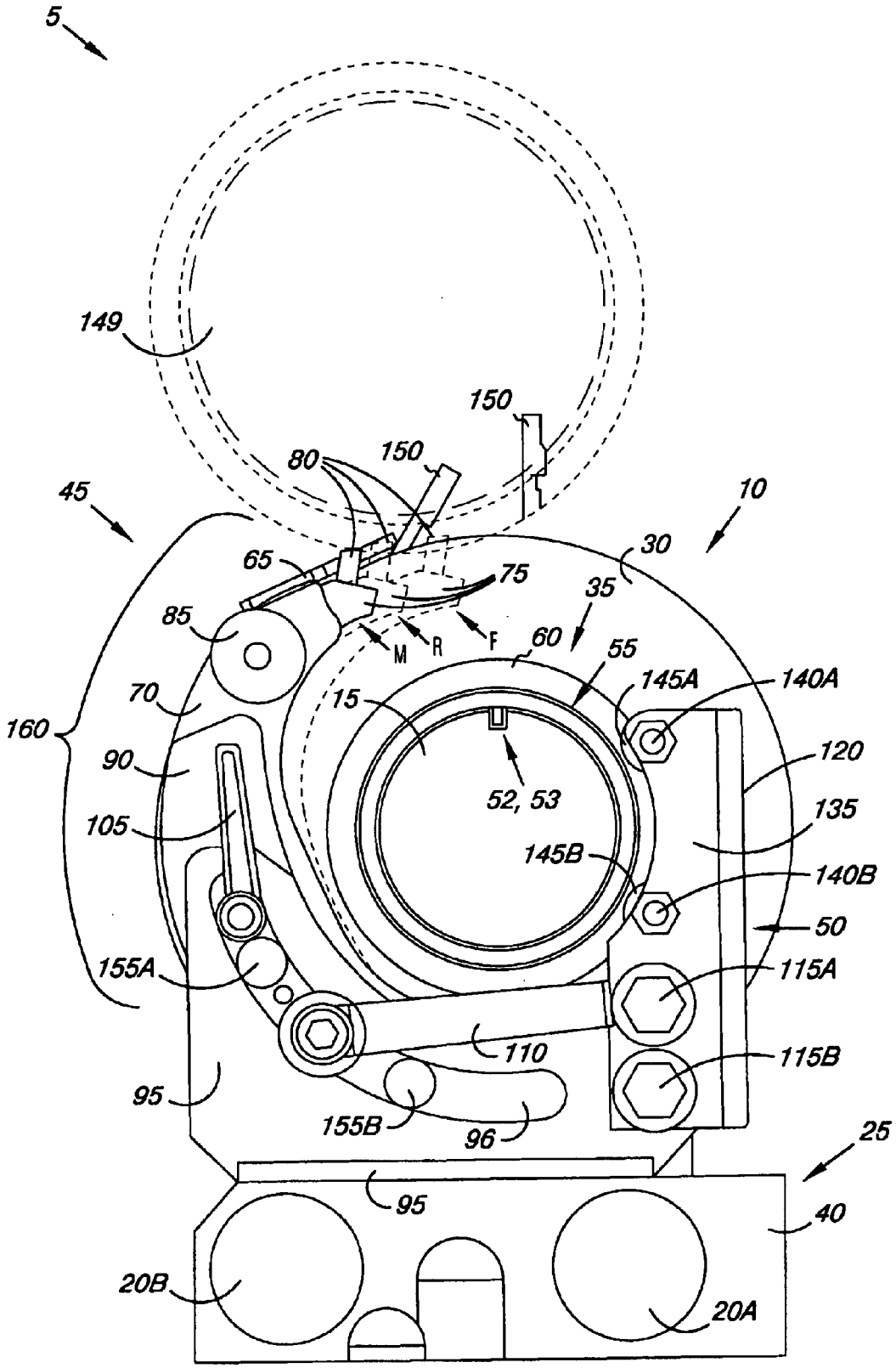
FIG. 4 is a detail view of the same elevation view as depicted in FIG. 3.

FIG. 4 is a detailed left side elevation view of the device 5 as shown in FIG. 3 and illustrates aspects of the stabilizer assembly 50 and the slotted base 95 that are hidden from view in FIG. 2. As shown in FIG. 4, the upper and lower hub rollers 145*a*, 145*b* are mounted on the second vertical plate 135 via bolts 140*a*, 140*b*. The hub rollers 145*a*, 145*b* rollably engage the cylindrical outer surface 55 of the hub 35 as the hub 35 rotates about axis A. The axis of each hub roller 145*a*, 145*b* is generally parallel to axis A. Thus, in one embodiment of the invention, the hub rollers 145*a*, 145*b* allow the stabilizer assembly 50 to maintain the indexing assembly 45 (i.e., the guide finger 65) in position relative to the grinding wheel 30 and axis A by resisting a torsional moment about axis A; the hub rollers 145*a*, 145*b* prevent radial displacement of the indexing assembly 45 (i.e., the guide finger 65) relative to the grinding wheel 30 and axis A. In other words, by providing non-sliding bearing contact points between the stabilizer assembly 50 and the grinding wheel assembly 10, the stabilizer assembly 50 helps to maintain the indexing assembly 45 in position relative to the grinding wheel 30 while generating minimal part wear and friction between the elements of the grinding wheel assembly 10 and the stabilizer assembly 50.

In one embodiment of the invention, the contact surface of each hub roller 145*a*, 145*b* is brass. In other embodiments, the contact surface may be other metals such as steel, aluminum, copper, etc. In yet other embodiments, the contact surface may be nonmetallic materials such as rubber, plastic, glass, ceramic, or polymer composite.

In one embodiment of the invention, each hub roller 145*a*, 145*b* will have roller or ball bearings. In other embodiments, each hub roller 145*a*, 145*b* will have simple friction type bearings. In yet other embodiments, each hub roller 145*a*, 145*b* will be a high performance roller bushing.

FIG. 4 depicts an embodiment having two hub rollers 145*a*, 145*b*. However, other embodiments will utilize one hub roller or three or more hub rollers to resist the torsional moment about axis A without generating significant part wear or friction.

In other embodiments of the invention, the torsional moment is resisted by means other than rollers. For example, in one embodiment, the hub rollers 145*a*, 145*b* are replaced with an air bearing system where air is injected into a collar that is part of the stabilizer assembly 50 and surrounds at least a portion of the cylindrical outer surface 55 of the hub 35. The injected air is a bearing system, which resists the torsional moment about axis A while allowing the cylindrical outer surface 55 of the hub 35 to rotate within the collar without slidingly contacting the collar.

In FIG. 4, the slot cover 100 has been removed to reveal the curved slot 96 and a first set of cam followers 155*a*, 155*b*. The first set of cam followers 155*a*, 155*b* are mounted on the cam follower carrier 90 and travel through the curved slot 96 as the cam follower carrier 90, guide finger support 70, index finger 75, index finger travel adjustor 85, linear adjustment lock lever 105, and radial adjustment lock lever 110 displace relative to the slotted base 95. When the cam followers 155*a*, 155*b*, cam follower carrier 90, guide finger support 70, index finger 75, index finger travel adjustor 85, linear adjustment lock lever 105, and radial adjustment lock lever 110 displace as a single unit relative to the slotted base 95, the single unit is said to form a carrier-finger assembly 160. The carrier-finger assembly 160 may be displaced as a whole relative to the slotted base 90 when the linear adjustment lock lever 105 is in a locked position and the radial adjustment lock lever 110 is in an unlocked position. It should be noted that while the drawings depict a slot 96 in the slotted base 95 that is curved, in other embodiments of the device 5, the slot 96 may be linear or have other shapes. Also, in other embodiments, the orientation of the slot 96 may be horizontal, vertical, or inclined as needed to provide the desired adjustability relative to the blades 150.

FIG. 4 illustrates three positions for the indexing finger 75 and the relationship between the blades 150 of the cutting reel 149 and the grinding wheel 30, the index finger tip 80, and the guide finger 65. The three positions for the index finger 75 illustrated in FIG. 4 are the forward position, which is illustrated in dashed phantom lines and designated by the letter "F," the rearward position, which is illustrated in dotted phantom lines and designated by the letter "R," and the maximum rearward position illustrated in solid lines and designated by the letter "M."

In operation, the index finger 75 pivots on a pivot pin 170 (shown in FIG. 5) between the forward position F and the rearward position R. Prior to operation, the index finger travel adjustor 85 is used to set the rearward position R so the index finger tip 80 aligns with the guide finger 65 such that when the index finger 75 is in the rearward position R, the index finger tip 80 is positioned very slightly rearward of the tip of the guide finger 65. This allows the blade 150 to slide smoothly from the index finger tip 80, along the tapered edge of the guide finger 65, to the tip of the guide finger 65. The maximum rearward position M is shown in FIG. 4 only to give an idea of the range over which the rearward position R may be set from the forward position F.

Figure 5:
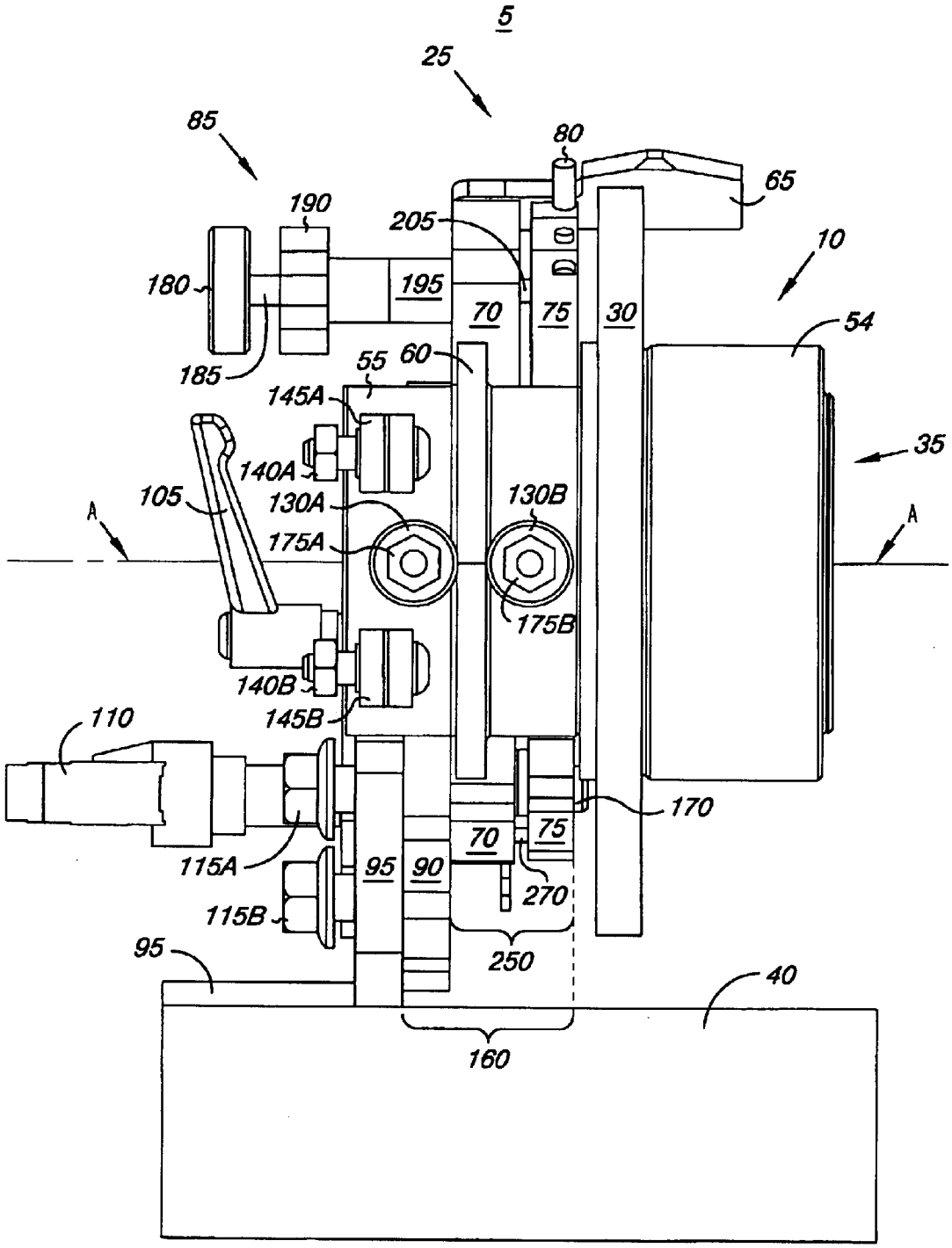
FIG. 5 is a front elevation view of the device wherein the line of sight runs towards the first vertical plate of the stabilizer assembly, wherein the first and second vertical plates of the stabilizer assembly have been made invisible to reveal aspects of the device that are hidden in the preceding FIGS.

FIG. 5 is a front elevation view of the device 5 wherein the first and second vertical plates 120, 135 of the stabilizer assembly 50 have been made invisible to reveal aspects of the device 5 that are hidden in the preceding four figures. As shown in FIG. 5, the flange 60 is located between the flange rollers 130*a*, 130*b*. The flange rollers 130*a*, 130*b* roll along the vertical surfaces of the flange 60 as the flange 60 rotates with the hub 35 about axis A. The flange rollers 130*a*, 130*b* are mounted by bolts 175*a*, 175*b* in the holes 125*a*, 125*b* of the first vertical plate 120. The axis of each flange roller 130*a*, 130*b* is generally perpendicular to axis A. Thus, in one embodiment of the invention, the flange rollers 130*a*, 130*b* allow the stabilizer assembly 50 to maintain the indexing assembly 45 (i.e., the guide finger 65) in position relative to the grinding wheel 30 and axis A by resisting a bending moment along axis A; the flange rollers 130*a*, 130*b* prevent axial displacement of the indexing assembly 45 (i.e., the guide finger 65) relative to the grinding wheel 30 and axis A. In other words, by providing non-sliding bearing contact points between the stabilizer assembly 50 and the grinding wheel assembly 10, the stabilizer assembly 50 helps to maintain the indexing assembly 45 in position relative to the grinding wheel 30 while generating minimal part wear and friction between the elements of the grinding wheel assembly 10 and the stabilizer assembly 50.

In one embodiment of the invention, the contact surface of each flange roller 130*a*, 130*b* is brass. In other embodiments, the contact surface may be other metals such as steel, aluminum, copper, etc. In yet other embodiments, the contact surface may be nonmetallic materials such as rubber, plastic, glass, ceramic, or polymer composite.

In one embodiment of the invention, each flange roller 130*a*, 130*b* will have roller or ball bearings. In other embodiments, each flange roller 130*a*, 130*b* will have simple friction type bearings. In yet other embodiments, each flange roller 130*a*, 130*b* will be a high performance roller bushing.

FIG. 5 depicts an embodiment having two flange rollers 130*a*, 130*b*. However, other embodiments will utilize one flange roller or three or more flange rollers to resist the bending moment along axis A without generating significant part wear or friction.

In other embodiments of the invention, the bending moment is resisted by means other than rollers. For example, in one embodiment, the flange rollers 130*a*, 130*b* are replaced with an air bearing system where air is injected into a collar that is part of the stabilizer assembly 50 and encompasses the annular stabilizer flange 60. The injected air is a bearing system, which resists the bending moment along axis A while allowing the annular stabilizer flange 60 to rotate within the collar without contacting the collar.

Figure 10:
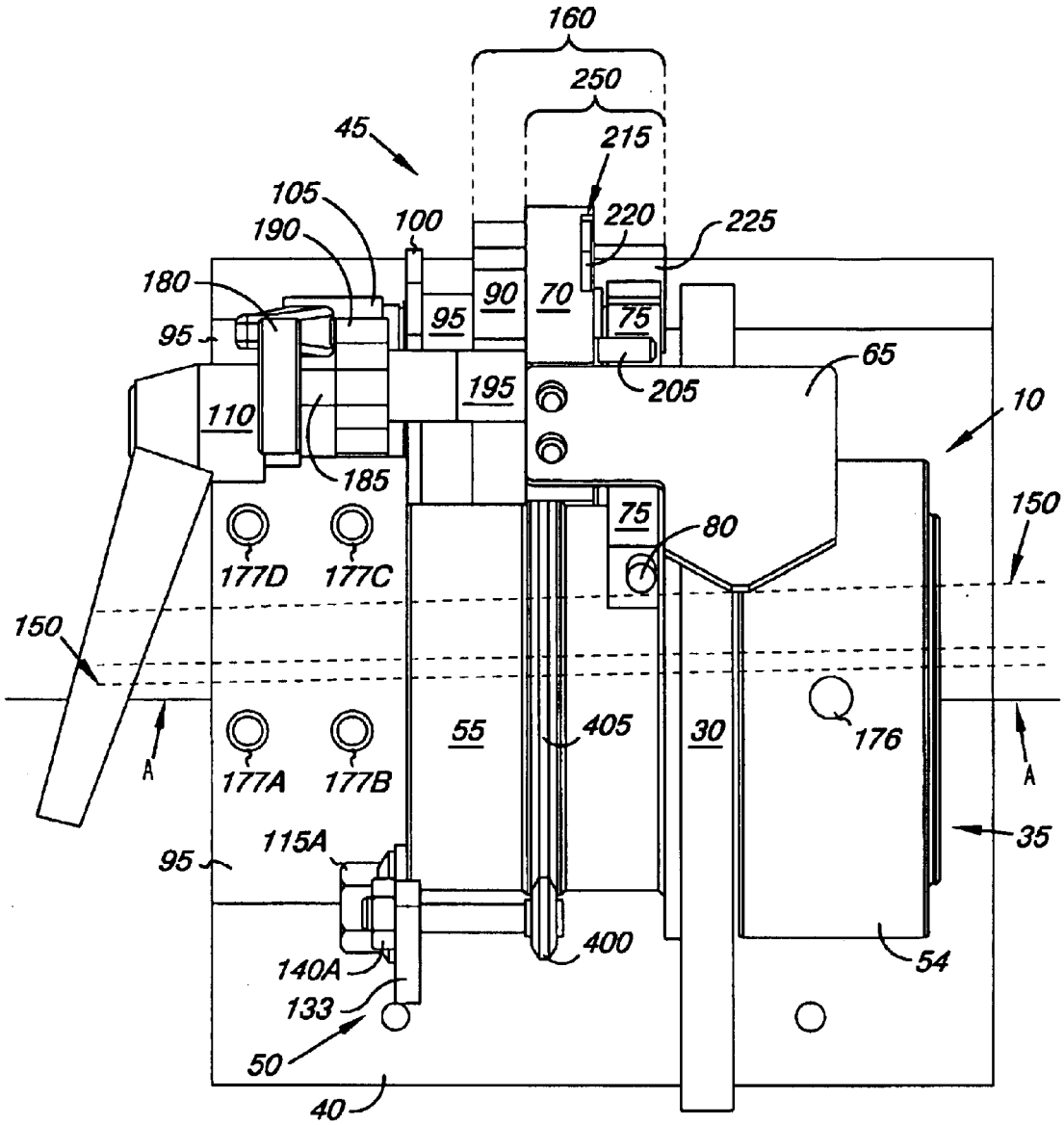
FIG. 10 shows a plan view of an alternative embodiment having a rolling bearing means for resisting both the torsional and bending moments.

In some embodiments of the invention, a rolling bearing means may be used to resist both the torsional and bending moments. For example, FIG. 10 shows a plan view of an alternative embodiment having a rolling bearing means for resisting both the torsional and bending moments. As illustrated in FIG. 10, a V-type roller 400 could be secured to the stabilizer assembly 50 so the roller's axis is generally parallel to axis A. The roller 400 could roll within a V-shaped or U-shaped bearing groove 405 cut into, and encircling, the cylindrical outer surface 55 of the hub 35. In a similar embodiment, a similarly arranged roller 400 could roll in a bearing groove 405 formed on the cylindrical outer surface 55 of the hub 35 between two annular stabilizer flanges 60 radially emanating from the hub 35. For greater stability, more than one V-type roller 400 could be radially positioned to ride in the bearing groove 405.

Figure 11:
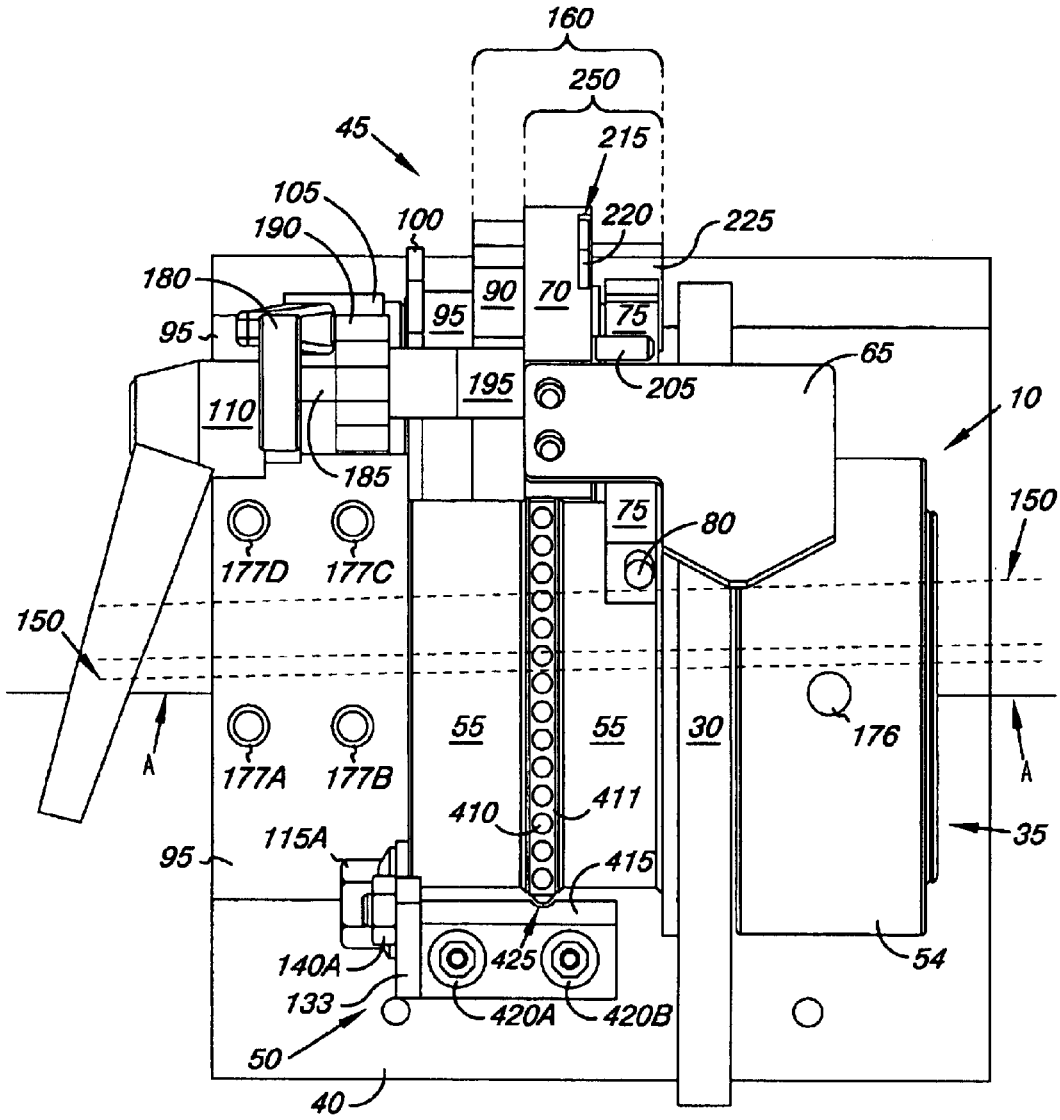
FIG. 11 shows a plan view of another alternative embodiment having a rolling bearing means for resisting both the torsional and bending moments.

FIG. 11 is another plan view of an alternative embodiment having a rolling bearing means for resisting both the torsional and bending moments. As illustrated in FIG. 11, a continuous set of ball bearings 410 is held in a ring 411 about the cylindrical outer surface 55 of the hub 35. A bearing receiving plate 415, which is connected to the second vertical plate 135 and secured to the traveling block 40 by two bolts 420*a*, 420*b*, is located generally parallel and adjacent to the cylindrical outer surface 55 of the hub 35.

In one embodiment, the receiving plate 415 radially encompasses at least a portion of the cylindrical outer surface 55 of the hub 35. In other words, the receiving plate 415 forms a collar about at least a part of the cylindrical outer surface 55 of the hub 35. The receiving plate 415 has a groove 425 that corresponds in size and orientation to the ball bearings 410 so as to mate with the ball bearings 410 as they travel along the receiving plate 415. The groove 425 transfers the torsional and bending moments to the ball bearings 410, which in turn transfers the moments to the shaft 15 via the hub 35. Thus, the groove 425 and bearings 410 interposed between the hub 35 and the stabilizer assembly 50 interact to prevent the guide finger 65 from being axially or radially deflected relative to axis A.

In another embodiment similar to the one shown in FIG. 11, the ring 411 of ball bearings 410 is supported on the receiving plate 415 and the groove 425 is located on the cylindrical outer surface 55 of the hub 35. Therefore, the ball bearings 410 transfer the torsional and bending moments to the groove 425, which in turn transfers the moments to the shaft 15 via the hub 35. Again, the bearings 410 and the groove 425 interposed between the hub 35 and the stabilizer assembly 50 interact to prevent the guide finger 65 from being axially or radially deflected relative to axis A.

Figure 6:
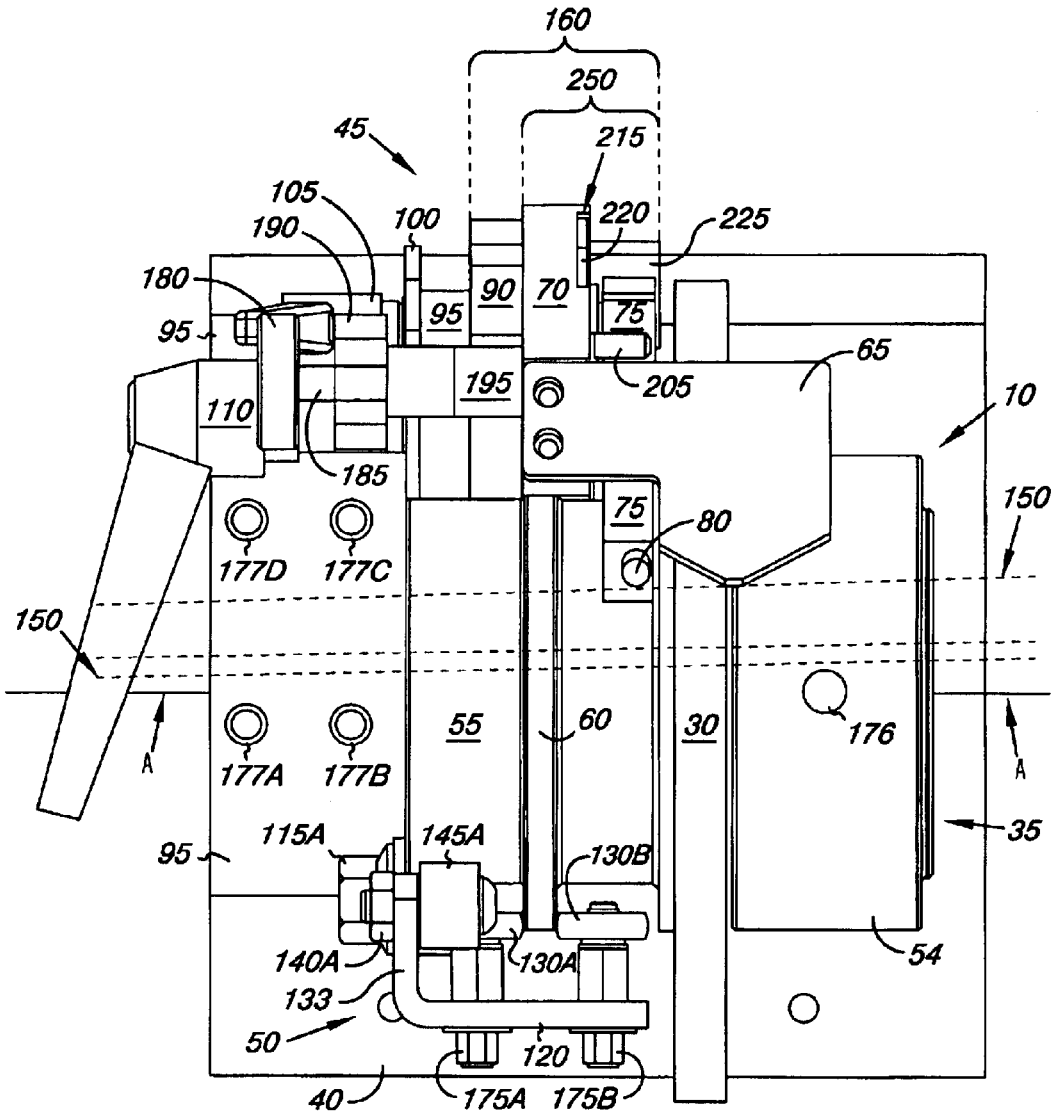
FIG. 6 is a plan view of the device with a blade of a cutting reel shown in phantom and abutting a guide finger, an index finger tip and a grinding wheel.

FIG. 6 is a plan view of the device 5 with a blade 150 abutting the guide finger 65, index finger tip 80, and grinding wheel 30. FIG. 6 reveals the threaded collar 54 has a spanner wrench hole 176. FIG. 6 also reveals that the slotted base 95 has four holes 177*a*, 177*b*, 177*c*, 177*d* for receiving bolts, which secure the slotted base to the traveling block 40.

As illustrated in FIG. 6, the index finger travel adjustor 85 comprises a pivot knob 180, an interior shaft 185, a securing knob 190, a casing 195, and a disk 200 (shown in FIG. 7) that has a stop pin 205. The interior shaft 185, the disk 200, and the stop pin 205 form a singular unitary piece. In another embodiment, the interior shaft 185, disk 200, and stop pin 205 may be separate pieces. The pivot knob 180 is mounted on the end of the interior shaft 185 opposite from the disk 200. The interior shaft 185 runs through the securing knob 190, the casing 195, and an adjustor hole 210 (shown in FIG. 7) near the top of the guide finger support 70.

The index finger travel adjustor 85 may be used to adjust the amount of clearance between the stop pin 205 and the back of the index finger 75, thereby allowing the rearward position R of the index finger 75 to be set at different positions relative to the forward position F. Decreasing the clearance between the stop pin 205 and the back of the index finger 75 decreases the distance that the index finger 75 may travel away from the forward position F to the rearward position R. In other words, the smaller the clearance between the stop pin 205 and the back of the index finger 75, the less position R is offset back from position F (see FIG. 4).

To adjust the amount of travel the index finger 75 may undergo from the forward position F to the rearward position R, the securing knob 190 is loosened and the pivot knob 180 is turned to rotate the disk 200, which brings the stop pin 205 closer to, or further away from, the back of the index finger 75. Prior to operation, the stop pin 205 is positioned so the index finger tip 80, when the index finger 75 is in the rearward R position, aligns with the guide finger 65 such that the index finger tip 80 is positioned very slightly rearward of the tip of the guide finger 65. This allows a blade 150 to transfer smoothly from the index finger tip 80, along the tapered edge of the guide finger 65, to the tip of the guide finger 65. Once the stop pin 205 is in the appropriate position, the securing knob 190 may be tightened to fix the stop pin 205 in place.

As shown in FIG. 6, the guide finger support 70 has a groove 215 in which a back plate 220 is located. The guide finger support 70 also has a spring base 225 connected to its side.

Figure 7:
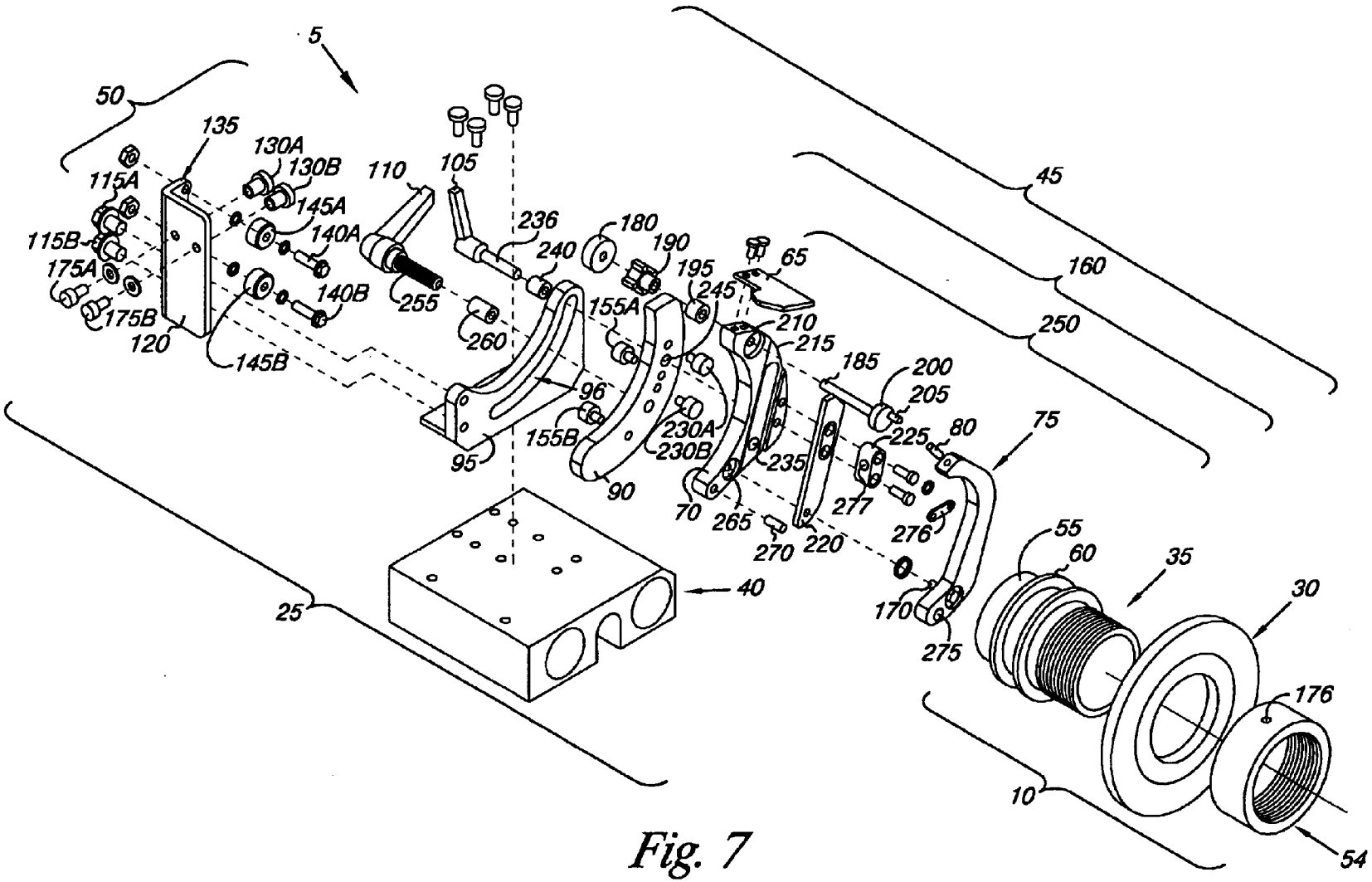
FIG. 7 is an exploded isometric view of the device.

To describe aspects of the device 5 that are hidden in the preceding figures and better illustrate the interrelationship of the various aspects of the device 5, reference is now made to FIG. 7. FIG. 7 is an exploded isometric view of the device 5. As shown in FIG. 7, a second set of cam followers 230*a*, 230*b* is mounted on the opposite side of the cam follower carrier 90 from the first set of cam followers 155*a*, 155*b*. The cam followers 230*a*, 230*b* are located within a linear slot 235 located in, and aligned with, the groove 215 of the guide finger support 70.

As indicated in FIG. 7, the linear adjustment lock lever 105 has an interior shaft 236 and a casing 240. The interior shaft 236 connects to the linear adjustment lock lever 105 on one end and the back plate 220 on the other. The interior shaft 236 runs from the linear adjustment lock lever 105 to the back plate 220 by passing through the casing 240, a hole 245 in the cam follower carrier 90, and the linear slot 235 of the guide finger support 70. The casing 240 nests within the curved slot 96 of the slotted base 95.

When the linear adjustment lock lever 105 is in an unlocked position and the radial adjustment lock lever 110 is in a locked position, the linear slot 235 may displace along the second set of cam followers 230*a*, 230*b* and the casing 240, and the groove 215 may displace along the back plate 220. At this time, the guide finger support 70, index finger 75, and index finger travel adjustor 85 may displace relative to the cam followers 230*a*, 230*b*, case 240, linear adjustment lock lever 110, radial adjustment lock lever 105, cam follower carrier 90, slotted base 95, and back plate 220. When the guide finger support 70, index finger 75, and index finger travel adjustor 85 displace as a single unit relative to the cam followers 230*a*, 230*b*, case 240, linear adjustment lock lever 110, radial adjustment lock lever 105, cam follower carrier 90, slotted base 95, and back plate 220, the single unit is said to form a finger assembly 250. It should be noted that while the drawings depict a slot 235 in the guide finger support 70 that is linear, in other embodiments of the device 5, the slot 235 may be curved or have other shapes. Also, in other embodiments of the device 5, the slot 235 may have a horizontal, vertical or inclined orientation.

The configurations of the carrier-finger assembly 160 and the finger assembly 250, along with their respective adjustors, the radial adjustment lock lever 110 and the linear adjustment lock lever 105, are advantageous. This is because the configurations allow the guide finger 65 to be positioned relative to the blade 150 and the grinding wheel 30 in a wide variety of manners. This is especially remarkable considering: (1) the compact nature of the carrier-finger assembly 160 and the finger assembly 250; and (2) the wide degree of positioning that may be achieved by manipulating no more than two adjustors, which are the linear adjustment lock lever 105 and the radial adjustment lock lever 110.

As shown in FIG. 7, the radial adjustment lock lever 110 has an interior shaft 255 and a casing 260. The interior shaft 255 runs from the radial adjustment lock lever 110 through the casing 260 and curved slot 96 to a connection with the cam follower carrier 90.

As illustrated in FIG. 7, the pivot pin 170 of the index finger 75 resides in a pivot pin hole 265 in the lower portion of the guide finger support 70. Below the pivot pin hole 265, a limit pin 270 protrudes from the guide finger support 70 into a limit hole 275 in the lower part of the index finger 75. The limit hole 275 is oversized so there is sufficient clearance between the limit pin 270 and the sides of the limit hole 275. This clearance is such that it allows the index finger 75 to pivot between the forward position F and the maximum rearward position M without exceeding a maximum preset distance between these positions (see FIG. 4).

As shown in FIG. 7, the spring base 225 is connected to the side of the guide finger support 70. A spring 276 is located between the spring base 225 and the back of the index finger 75. The spring 276 causes the index finger 75 to bias into the forward position F. One end of the spring 276 nests in a spring hole 277 in the spring base, and the other end of the spring 276 nests in a hole in the back of the index finger 75.

The operation of the device 5 during a relief grinding process will now be narrated while referring to FIGS. 1, 3, 4, 6 and 7. The cutting reel 149 is located above the device 5. The device 5 is positioned at a starting point wherein the device 5 straddles one end of the cutting reel 149 so that the grinding wheel 30 and guide finger 65 are located outside of the end of the blades 150 (i.e., the grinding wheel 30 and the guide finger 65 are located outside the envelope of the cutting reel 149) while the index finger tip 80 is located inside the end of the blades 150 (i.e., the index finger tip 80 is located inside the envelope of the cutting reel 149).

A motor biases the cutting reel 149 so the blades 150 rotate clockwise as designated by rotational arrow CW when viewed as shown in FIG. 3. The biasing of the cutting reel 149 forces a blade 150 against the index finger tip 80, which is maintained in the forward position F by the spring 276 compressed between the index finger 75 and the spring base 225. The biased blade 150 forces the index finger 75 back against the spring 276 until the rearward travel of the index finger 75 is arrested by the stop pin 205. The index finger 75 is now in the rearward position R, which is the position illustrated in FIGS. 4 and 6. As previously explained, the rearward position R has been set via the index finger travel adjustor 85 so the index finger tip 80 aligns with the guide finger 65 such that the index finger tip 80 is positioned very slightly rearward of tip of the guide finger 65. This allows the blade 150 to slide smoothly from the index finger tip 80, along the tapered edge of the guide finger 65, to the tip of the guide finger 65.

The device 5 is displaced along its rails 20*a*, 20*b* towards the opposite end of the blades 150. Specifically, a displacement force is applied to the traveling block 40 that causes the traveling block 40 and its stabilizer assembly 50 to travel along the rails 20*a*, 20*b* as the rotating shaft 15 causes the hub 35 to rotate about axis A in a counterclockwise manner as indicated in FIG. 3 by rotational arrow CCW. As the stabilizer assembly 50 displaces, the flange rollers 130*a*, 130*b*, which are in rolling bearing contact with the rotating flange 60, cause the rotating hub 35 to displace along the rotating shaft 15.

In one embodiment of the invention, the displacement force is applied to the traveling block 40 via a chain or cable. In another embodiment, the force is applied via a threaded shaft or pinion and gear rack. In yet other embodiments, the force is applied via a hydraulic or pneumatic ram or system of mechanical levers or any other means of applying a displacing force to the traveling block 40.

As the device displaces, the blade 150 transfers from the index finger tip 80 to the guide finger 65 and the spinning grinding wheel 30 makes contact with the blade 150. As the grinding wheel 30 is displaced along the blade 150, the blade 150 undergoes a relief grinding process as it follows the guide finger 65.

The device 5 travels the length of the blade 150 to the end of the blade 150 opposite the starting point, which is called, for the purposes of this specification, the end point. The device 5 stops traveling once it reaches the end point, which is where the index finger tip 80 has passed the end of the blade 150 being relief ground (i.e., the index finger 80 has passed the end of the envelope of the cutting reel 149) while the blade 150 being relief ground still remains biased against the guide finger 65 (i.e., the guide finger 65 is still within the envelope of the cutting reel 149).

At this point, the index finger tip 80 is no longer held in the rearward position R by the blade 150 being relief ground. As a result, the index finger 75 biases forward into the forward position F. Once the index finger 75 is in the forward position F, the device 5 begins traveling back to the starting point. As the device 5 returns to the starting point, the guide finger 65 travels along the front of the blade 150 being relief ground while the index finger point 80 travels along the back of the blade 150.

Once the device 5 reaches the starting point, the guide finger 65 slides past the end of the blade 150 being relief ground and the cutting reel rotates, bringing a new blade 150 forward to the index finger tip 80 in the forward position F. The new blade catches on the index finger tip 80 and forces the index finger 75 back into the rearward position R. The new blade 150 transfers from the index finger point 80 to the guide finger 65 as the device 5 begins to return to the end point. The process continues to cycle in the aforementioned manner until all of the blades 150 on the cutting reel 149 have been relief ground.

As explained above, the blade 150 being relief ground is biased against the indexing assembly 45 (i.e., the guide finger) while the grinding wheel 30 travels along the blade 150. Therefore, the biased blade 150 exerts a force on the guide finger 65. The force causes a torsional moment about axis A that is resisted by the rails 20*a*, 20*b* and by hub rollers 145*a*, 145*b*, which are in rolling contact with the rotating cylindrical outer surface 55 of the hub 35. The force also causes a bending moment along axis A that is resisted by the rails 20*a*, 20*b* and by the flange rollers 130*a*, 130*b*, which are in rolling contact with the rotating annular flange 60 of the hub 35.

The resistance to the torsional moment provided by the hub rollers 145*a*, 145*b* prevents the guide finger 65 from radially deflecting (i.e., deflecting front to back). The resistance to the bending moment provided by the flange rollers 130*a*, 130*b* prevents the guide finger 65 from axially deflecting (i.e., deflecting side to side). Thus, the flange and hub rollers 130*a*, 130*b*, 145*a*, 145*b* allow the device 5 to maintain tight tolerances between the position of the outer radial surface of the grinding wheel 30 and the guide finger 65 during a relief grinding process. In other words, the flange and hub rollers 130*a*, 130*b*, 145*a*, 145*b* allow the guide finger 65 to remain fixed relative to axis A. The resistance to the moments provided by the flange and hub rollers 130*a*, 130*b*, 145*a*, 145*b* also allows the use of rails 20*a*, 20*b* that are of a diameter that is commonly utilized in relief grinding systems that employ a common rotating shaft 15.

In another embodiment, the hub rollers 145*a*, 145*b* and or flange rollers 130*a*, 130*b* are eliminated and the moment(s) is/are resisted by rails 20*a*, 20*b*, which have been increased in diameter to increase their stiffness. To achieve the necessary stiffness, steel circular rails should have a diameter of at least approximately 3.5 inches. Rails made of other materials will have greater or lesser minimum diameters depending on the modulus of elasticity of the materials utilized. Increasing the rail diameter requires a corresponding increase in the size of the traveling block 40.

Figure 8A:
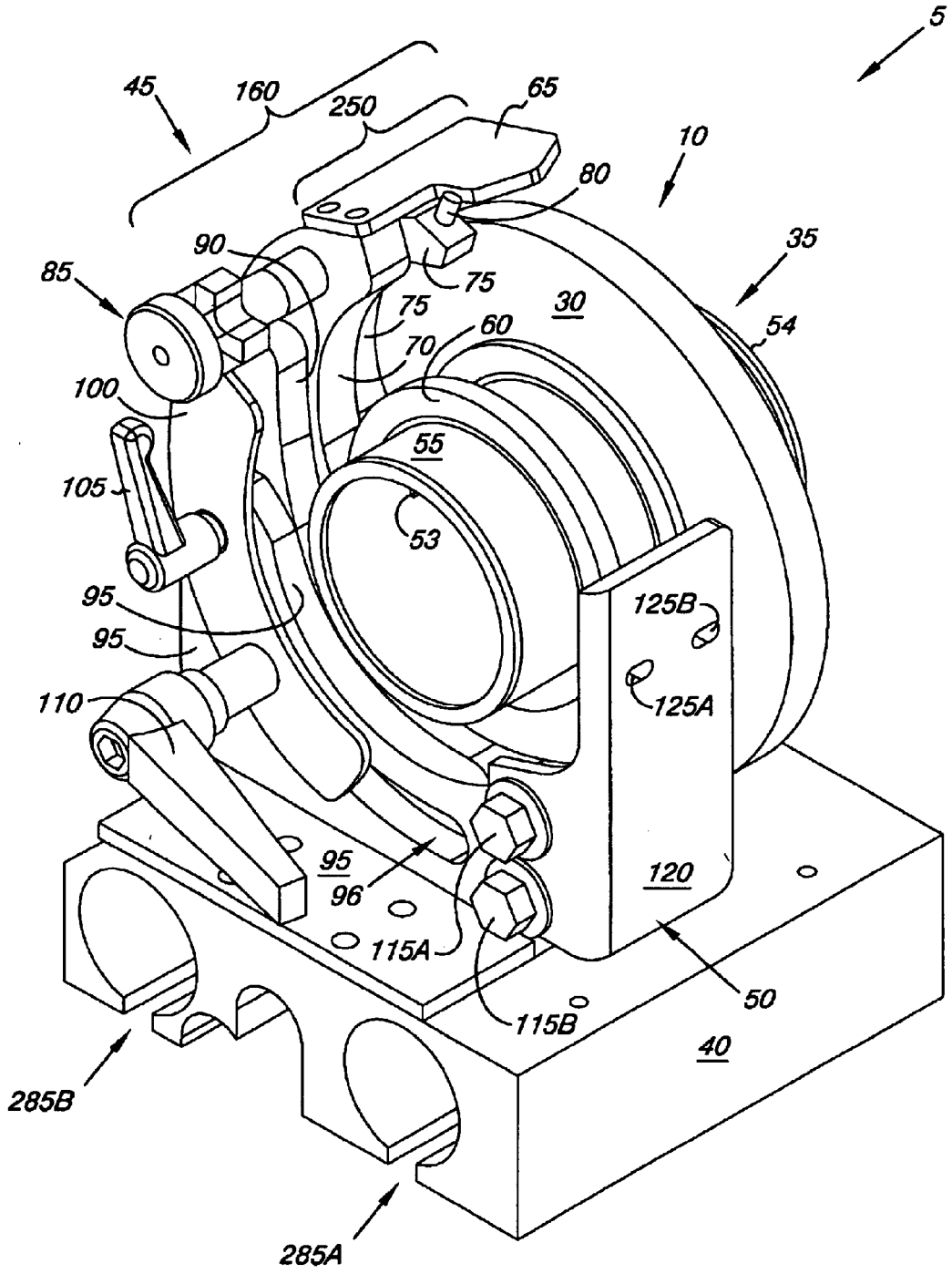
FIG. 8*a* is an isometric view of an alternative embodiment of the device, which utilizes profiled holes for receiving a profiled rail.
Figure 8B:
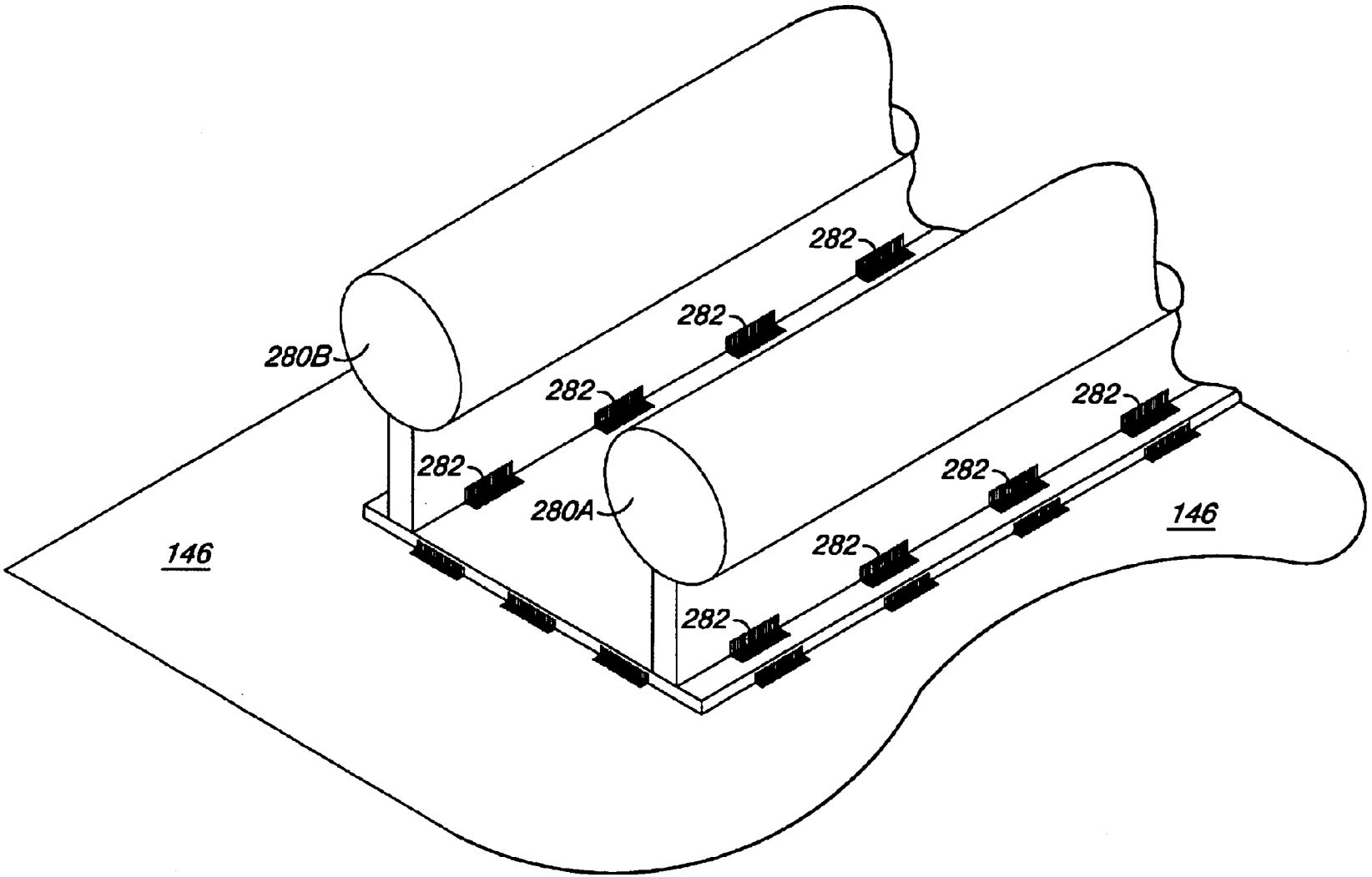
FIG. 8*b* is an isometric view of the profiled rails for use with the profiled holes illustrated in FIG. 8*a*.

In another embodiment, as illustrated in FIGS. 8*a* and 8*b*, the hub rollers 145*a*, 145*b* and/or flange rollers 130*a*, 130*b* are eliminated and the moment(s) is/are resisted by profiled rails 280*a*, 280*b*, which have diameters that are commonly utilized in relief grinding systems that employ a common rotating shaft 15. As shown in FIG. 8*b*, the profiled rails 280*a*, 280*b* are stiffened by connection points 282 between the profiled rails 280*a*, 280*b* and the surrounding framework 146 of the overall grinding system 147. As shown in FIG. 8*a*, the profiled rails 280*a*, 280*b* pass through similarly profiled holes 285*a*, 285*b* in the traveling block 40.

Figure 9A:
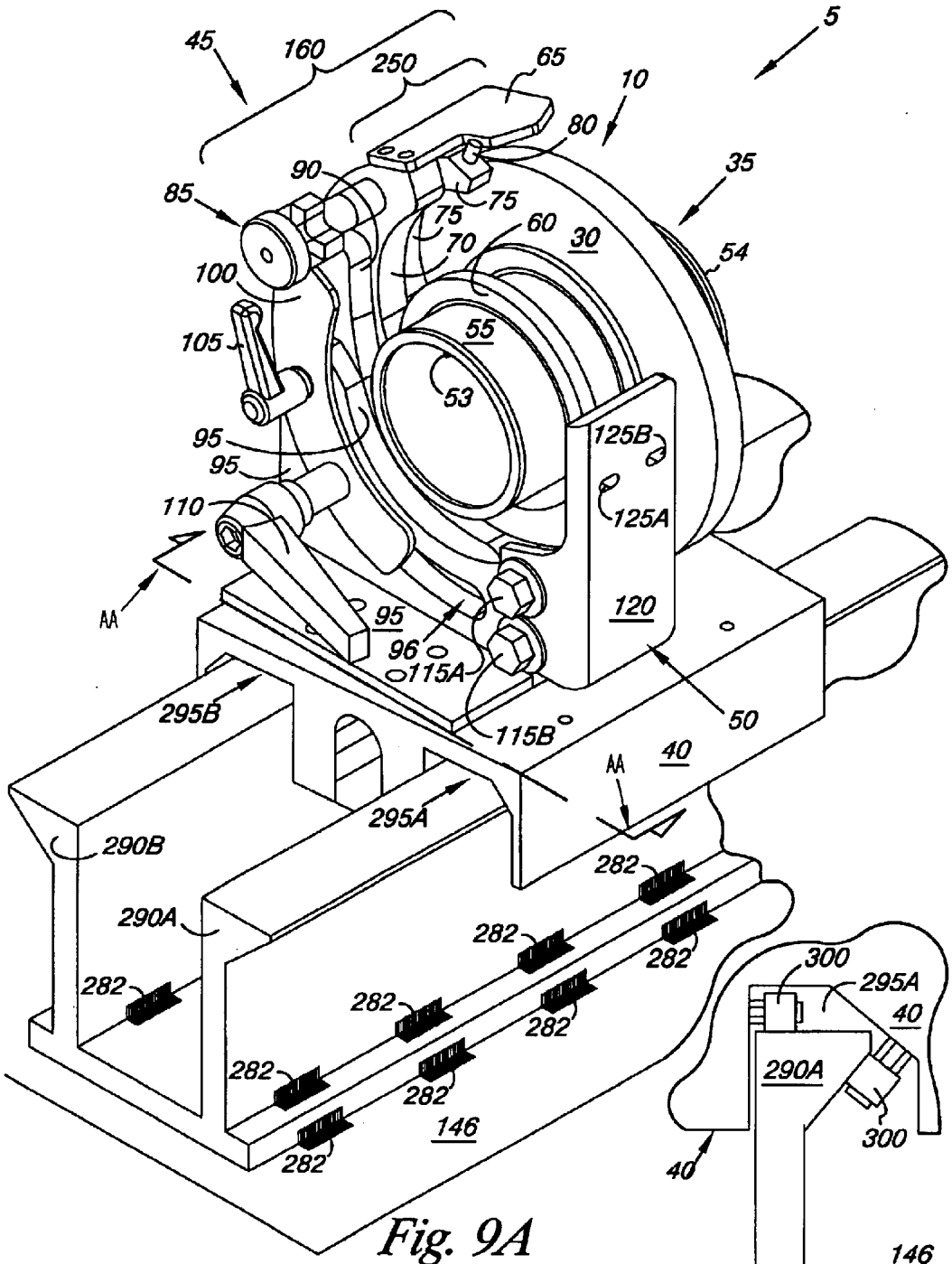
FIG. 9*a* is an isometric view of another alternative embodiment of the device, which utilizes another type of profiled rail.
Figure 9B:
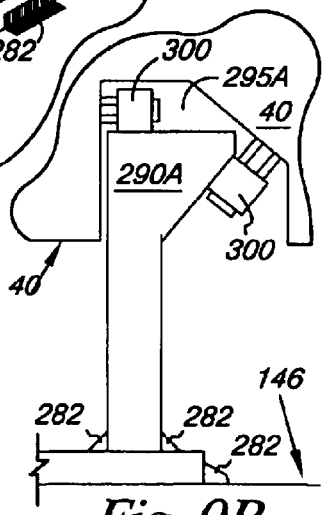
FIG. 9*b* is a cross-sectional elevation view taken along section line AA of the right profiled rail of the alternative embodiment depicted in FIG. 9*a*, wherein the rail is in its receiving hole within the device, and the hole has rollers that rollably interface with the faces of the profiled rail.

In another embodiment, as shown in FIGS. 9*a* and 9*b*, the profiled rails 290*a*, 290*b* are stiffened by connection points 282 between the profiled rails 290*a*, 290*b* and the surrounding framework 146 of the overall grinding system 147. FIG. 9*b* is a sectional elevation of the right profiled rail 290*a* taken along section line AA of FIG. 9*a*. As indicated in FIG. 9*b*, the profiled rails 290*a*, 290*b* pass through holes 295*a*, 295*b* in the traveling block 40. The holes 295*a*, 295*b* have rollers 300 that roll along the faces of the profiled rails 290*a*, 290*b*.

Some embodiments of the invention, to resist the moments, will utilize both a system of rolling bearing elements in the stabilizer assembly 45 and a profiled rail system. Other embodiments will rely mainly on a system of rolling bearing elements in the stabilizer assembly 45 to resist the moments. Finally, other embodiments will rely solely on a profiled rail system to resist the moments.

In the embodiments utilizing profiled rails, the profiled rails allow the guide assembly 25 to maintain the indexing assembly 45 in position relative to the grinding wheel 30 by resisting a torsional moment about axis A and/or a bending moment along axis A. In other words, the guide assembly 25 does not need to rely on contact between the grinding wheel assembly 10 and the bearing system elements of the guide assembly 25 in order to resist the moment(s) while maintaining the indexing assembly 45 in position relative to the grinding wheel 30 and axis A.

In the embodiments where all of the moments are resisted by profiled rails and the moment resisting rollers 130*a*, 130*b*, 145*a*, 145*b* are eliminated, the grinding wheel 10 assembly may be moved axially along the rotating shaft 15 via light duty rollers or sliding type forks. The light duty rollers or sliding type forks would be mounted on the guide assembly 25 and would act on a flange 60, a groove in the cylindrical outer surface 55 of the hub 35, or other similar features of the hub 35. The light duty rollers or sliding type forks would experience minimal part friction and wear because they would not need to resist the moments.

Although the present invention has been described with reference to preferred embodiments, persons skilled in the art will recognize that changes may be made in form and detail without departing from the spirit and scope of the invention.

We claim:

1. A device for relief grinding a blade having a radially outer edge of an elongated length and first and second faces, with the first and second faces extending generally radially from a reel axis, comprising:

a rotatable grinding shaft defining a grinding wheel axis;

a grinding wheel rotatable with and axially slideable along the grinding shaft to follow the elongated length of the blade, said grinding wheel including a hub with a first bearing surface;

a grinding wheel guide assembly mounted for motion parallel to the grinding wheel axis on at least one rail that extends the elongated length of the blade and is substantially parallel to the grinding wheel axis;

a guide finger adjustably supported on the grinding wheel guide assembly for contacting one face of the blade during grinding and holding the blade in position for relief grinding; and a first non-sliding stabilizer bearing supported on the grinding wheel guide assembly for bearing contact with the first bearing surface, said first stabilizer bearing oriented to apply to the first bearing surface forces applied to the grinding wheel guide assembly that include a component parallel to the grinding wheel axis.

2. The device of claim 1 wherein the first bearing surface is an annular stabilizer flange on the hub that rotates with the grinding wheel in a plane perpendicular to the grinding wheel axis and the first non-sliding stabilizer bearing supported on the grinding wheel guide assembly is a rotating bearing for rotational contact with the stabilizer flange, said stabilizer bearing rotating around an axis perpendicular to the grinding wheel axis.

3. The device of claim 2 wherein the stabilizer flange has opposed, parallel annular surfaces and the first stabilizer bearing is a pair of opposed rotating bearings supported on the grinding wheel guide assembly, each in rotational contact with one of said opposed annular surfaces.

4. The device of claim 1 wherein the blade is one of a plurality of blades mounted in a reel and the reel is supported for rotation about the reel axis to position the plurality of blades for grinding contact with the grinding wheel, further comprising an indexing finger supported on the grinding wheel guide assembly for reciprocal motion in a plane substantially perpendicular to the grinding wheel axis, to receive a next blade for grinding.

5. The device of claim 1 wherein the hub has a second bearing surface and further comprising a second non-sliding stabilizer bearing supported on the grinding wheel guide assembly for bearing contact with the second bearing surface, said second stabilizer bearing oriented to apply to the second bearing surface forces applied to the grinding wheel guide assembly that include a component perpendicular to the grinding wheel axis.

6. The device of claim 5 wherein the second bearing surface is a cylindrical surface on the hub that rotates with the grinding wheel around the grinding wheel axis and the second non-sliding stabilizer bearing supported on the grinding wheel guide assembly is a rotating bearing for rotational contact with the cylindrical surface, the rotational axis of the second stabilizer bearing being substantially parallel with the grinding axis.

7. The device of claim 6 wherein the second, non-sliding stabilizer bearing is a pair of rotating bearings supported on the grinding wheel guide assembly, each in rotational contact with said cylindrical surface at a pair of spaced points on said cylindrical surface.

8. The device of claim 1 further comprising a guide finger support assembly, comprising:

a guide finger support;

a slotted base operably connected to the grinding wheel guide assembly;

a first cam follower on a cam follower carrier, said first cam follower being received in a first adjustment slot located in the slotted base; and a first lock mechanism for frictionally locking the cam follower carrier in position relative to the base at a point along the first adjustment slot.

9. The device of claim 8 further comprising:

a second adjustment slot located in the guide finger support;

a second cam follower on the cam follower carrier, said second cam follower being received in the second adjustment slot; and a second lock mechanism for frictionally locking the guide finger support in position relative to the cam follower carrier at a point along the second adjustment slot.

10. The device of claim 9 where the blade is one of a plurality of blades mounted in a reel and the reel is supported for rotation about the reel axis to position the plurality of blades for grinding contact with the grinding wheel, further comprising an index finger supported on the guide finger support for reciprocal motion in a plane substantially perpendicular to the grinding wheel axis, to receive a next blade for grinding.

11. A device for relief grinding a blade having a radially outer edge of an elongated length and first and second faces, with the first and second faces extending generally radially from a reel axis, comprising:

a rotatable grinding shaft defining a grinding wheel axis;

a grinding wheel rotatable with and axially slideable along the grinding shaft to follow the elongated length of the blade, said grinding wheel including a hub with a stabilizer bearing surface;

a grinding wheel guide assembly mounted for motion parallel to the grinding wheel axis on at least one rail that extends the elongated length of the blade and is substantially parallel to the grinding wheel axis;

a guide finger adjustably supported on the grinding wheel guide assembly for contacting one face of the blade during grinding and holding the blade in position for relief grinding; and a first non-sliding stabilizer bearing interposed for bearing contact between the grinding wheel guide assembly and the stabilizer bearing surface, said first stabilizer bearing oriented to apply to the stabilizer bearing surface forces applied to the grinding wheel guide assembly including both a component parallel to the grinding wheel axis and a component perpendicular to the grinding wheel axis.

12. A method for relief grinding a blade having a radially outer edge of an elongated length and first and second faces, with the first and second faces extending generally radially from a reel axis, comprising:

providing a rotatable grinding shaft defining a grinding wheel axis;

providing a grinding wheel rotatable with and axially slideable along the grinding shaft to follow the elongated length of the blade, said grinding wheel including a hub with a first bearing surface;

providing a grinding wheel guide assembly mounted for motion parallel to the grinding wheel axis on at least one rail that extends the elongated length of the blade and is substantially parallel to the grinding wheel axis;

providing a guide finger adjustably supported on the grinding wheel guide assembly for contacting one face of the blade during grinding and holding the blade in position for relief grinding;

providing a first non-sliding stabilizer bearing supported on the grinding wheel guide assembly for bearing contact with the first bearing surface; and positioning a blade against the guide finger for grinding and during grinding transferring to the first bearing surface via the first stabilizer bearing forces applied to the grinding wheel guide assembly that include a component parallel to the grinding wheel axis.

13. The method of claim 12 wherein the step of providing a first bearing surface comprises providing an annular stabilizer flange on the hub that rotates with the grinding wheel in a plane perpendicular to the grinding wheel axis and the step of providing a first non-sliding stabilizer bearing supported on the grinding wheel guide assembly comprises providing a rotating bearing for rotational contact with the stabilizer flange, said stabilizer bearing rotating around an axis perpendicular to the grinding wheel axis.

14. The method of claim 13 wherein the step of providing a stabilizer flange comprises providing a stabilizer flange that has opposed, parallel annular surfaces and the step of providing the first stabilizer bearing comprises providing a pair of opposed rotating bearings supported on the grinding wheel guide assembly, each in rotational contact with one of said opposed annular surfaces.

15. The method of claim 12 wherein the blade is one of a plurality of blades mounted in a reel and further comprising:

supporting the reel for rotation about the reel axis to position the plurality of blades for grinding contact with the grinding wheel; and providing an indexing finger supported on the grinding wheel guide assembly for reciprocal motion in a plane substantially perpendicular to the grinding wheel axis, to receive a next blade for grinding.

16. The method of claim 12 further comprising providing on the hub a second bearing surface and providing a second non-sliding stabilizer bearing supported on the grinding wheel guide assembly for bearing contact with the second bearing surface; and during grinding transferring to the second bearing surface via the second stabilizer bearing forces applied to the grinding wheel guide assembly that include a component perpendicular to the grinding wheel axis.

* * * * *